United States Patent [19]

Rerecich

[11] 3,998,084

[45] Dec. 21, 1976

[54] COOLING SPRAY SYSTEM FOR ROLLING MILL

[75] Inventor: Francis Rerecich, Dover, N.J.

[73] Assignee: Marotta Scientific Controls, Inc., Boonton, N.J.

[22] Filed: Nov. 1, 1974

[21] Appl. No.: 520,353

[52] U.S. Cl. ..... 72/201; 266/134

[51] Int. Cl.[2] ..... B21B 45/02

[58] Field of Search ..... 72/13, 200, 201, 202, 72/236, 14, 41–45; 239/533, 550, 551, 562; 266/4 S, 6 S, 3 R

[56] References Cited

UNITED STATES PATENTS

| | | | |
|---|---|---|---|
| 2,230,897 | 2/1941 | McBain et al. | 72/201 |
| 2,319,309 | 5/1943 | Emigh | 72/200 |
| 2,811,059 | 10/1957 | Appleby | 72/201 |
| 3,053,461 | 9/1962 | Inglis | 239/533 |
| 3,499,456 | 3/1970 | Rerecich et al. | 239/533 |
| 3,523,437 | 8/1970 | Bales et al. | 72/43 |
| 3,533,261 | 10/1970 | Hollander et al. | 72/201 |
| 3,640,466 | 2/1972 | Steiger | 239/533 X |
| 3,669,354 | 6/1972 | Helyer | 239/533 X |
| 3,763,679 | 10/1973 | Lane et al. | 72/201 X |
| 3,771,730 | 11/1973 | Nicoloff et al. | 239/550 X |
| 3,856,281 | 12/1974 | Bertolotti et al. | 266/3 R |
| 3,880,358 | 4/1975 | Schaming | 239/551 |

FOREIGN PATENTS OR APPLICATIONS

| | | | |
|---|---|---|---|
| 47-6013 | 2/1972 | Japan | 72/200 |

*Primary Examiner*—C.W. Lanham
*Assistant Examiner*—E. M. Combs
*Attorney, Agent, or Firm*—Sandoe, Hopgood, Calimafde

[57] ABSTRACT

Rolling mills require uniform temperature control across the width of the sheet in order to roll a flat metal sheet of uniform gauge. This invention provides a rolling mill with spray nozzles that operate in groups to maintain substantially uniform temperature across the width of the sheet metal. Back pressure of the coolant within the cooling spray nozzle adjustment means obtains automatic control of individual nozzle adjustment to make the rate of flow of the coolant to the sheet metal workpiece always obtain substantially uniform temperature of the metal. In place of back pressure, other signal energy supplied to nozzle adjustment can be used. The nozzles are carried by spray boards that adjust to control the angle of impingement of the nozzle sprays against the sheet metal; and there is a novel construction for transmitting liquid between fixed passage to other passages in the angularly adjustable spray boards without the use of hoses.

13 Claims, 12 Drawing Figures

COOLING SPRAY SYSTEM FOR ROLLING MILL

BACKGROUND AND SUMMARY OF THE INVENTION cooling

Apparatus for rolling sheet metal, and particularly cluster mills, require cooling of the sheet metal at the working roll pass; and the amount of colling required may be greater toward the center of the sheet than it is along the edges. Uniform cooling sprays that withdraw equal heat from the metal across its entire width are not satisfactory, therefore, because this results in cumulative buildup of heat at local areas, such as the center region of the sheet. Even distribution of temperature across the sheet is important to obtain a uniform gauge of the rolled sheet.

This invention provides rows of spray nozzles spaced from one another widthwise across the sheet. These nozzles are divided into groups. There is one group for cooling a zone extending along the center region of the sheet; and then there is another group of nozzles which cools zones on both sides of the center zone. The third group of nozzles cools zones which are nearer to the edges of the sheets and adjacent to the portions of the second zones which are remote from the center zone. Provision is made for operating more nozzles when the sheet is wider and fewer nozzles when the sheet being rolled is narrower.

The nozzles are adjustable to change the spray so that the rate of flow can be controlled and also the shape of the spray if desired. In the preferred construction of this invention, each nozzle has individual nozzle adjusting means operated by the controlled pressure of the coolant.

The nozzles are preferably of the type in which a tongue moves axially in an orifice. The surface of either the orifice or the tongue, or both, is tapered so that as the tongue moves axially with respect to the orifice, the cross section through which coolant can be discharged is increased or decreased.

By attaching the tongue of the nozzle to a piston or other movable wall, and then subjecting this wall to the pressure of coolant supplied to the nozzle, or to other controlled force, automatic adjustment of the nozzle discharge can be obtained as the result of variations in control pressure.

The nozzle adjustment can be effected in various ways depending upon whether the control pressure is used to move the piston or movable wall in a direction to increase the flow or decrease the flow of coolant. Apparatus for carrying out the invention in different ways will be explained in connection with the detailed description of the structure shown in the drawing.

Back pressure regulators or loaded valves (relief valves) are used in connection with the preferred pressure controls of this invention; and these back pressure regulators or loaded valves can be adjusted to control the pressure which is generated by a particular flow of coolant. Also pressure regulators upstream from the nozzles of individual groups of nozzles serve as regulators which influence the individual nozzle adjusting mechanisms.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
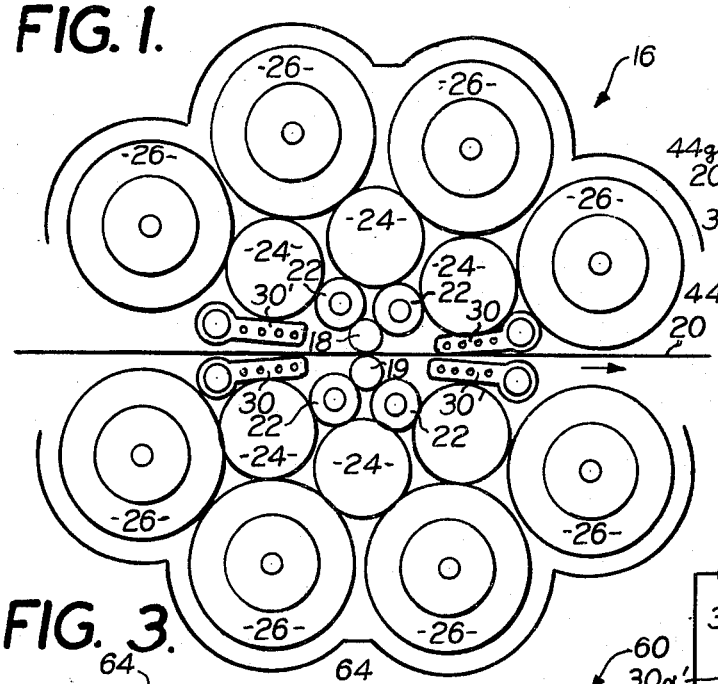
FIG. 1 is a diagrammatic view of a cluster mill with a length of sheet metal passing through it and being reduced, and with cooling in accordance with this invention.

FIG. 1 shows a cluster mill 16 which has working rolls 18 and 19 through which a length of sheet metal passes to reduce the gauge of the sheet metal in accordance with well-known practice. The working rolls 18 and 19 are held under pressure against the sheet metal 20 and held against bending by back-up rolls 22; there being two such back-up rolls over the upper roll 18 and two similar back-up rolls 22 under the lower working roll 19.

The back-up rolls 22 are held under pressure and against bending by larger and heavier back-up rolls 24, disposed as shown in FIG. 1 with each of the smaller back-up rolls 22 in contact with two of the back-up rolls 24. These larger back-up rolls 24 are held under pressure against the smaller back-up rolls 22 by still larger and heavier back-up rolls 26 which are disposed around the back-up rolls 24, as shown in FIG. 1 and in such a way that each of the intermediate back-up rolls 24 is in contact with at least two of the outer and heaviest back-up rolls 26. This is a conventional cluster mill commonly used for rolling sheet metal.

A considerable heat is generated in the sheet metal 20 as it passes between the working rolls 18 and 19. The amount of heat generated depends on the extent to which the gauge of the metal is reduced by the rolls 18 and 19. The heat generated near the longitudinal edges of the sheet metal 20 can be dissipated from the edges to the cooler air along the edges of the strip; but the heat generated near the center of the strip cannot cool as quickly since it has hot metal on both sides of it.

This results in an unequal temperature across the width of the sheet metal strip 20 and the temperature difference causes uneven expansion of the sheet metal and variations in the gauge of the sheet metal widthwise so that when the metal cools there are stresses that produce an uneven contour; that is, the sheet metal does not lie flat and its gauge is not uniform.

Figure 2A:
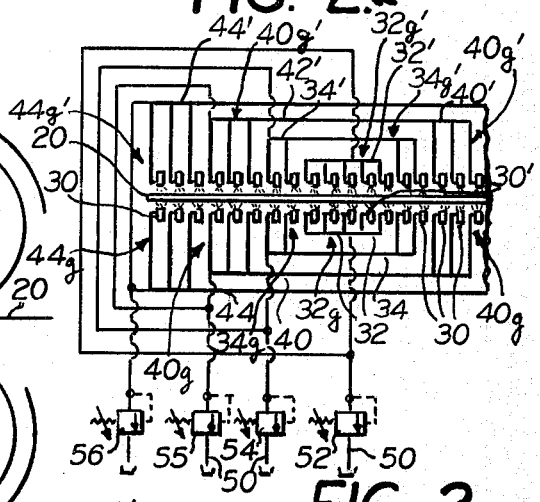
FIG. 2*a* is a piping diagram showing exhaust passages for control fluid from different groups of the nozzle controls that are supplied with coolant, from a common supply source, by the passages shown in FIG. 2.
Figure 2:
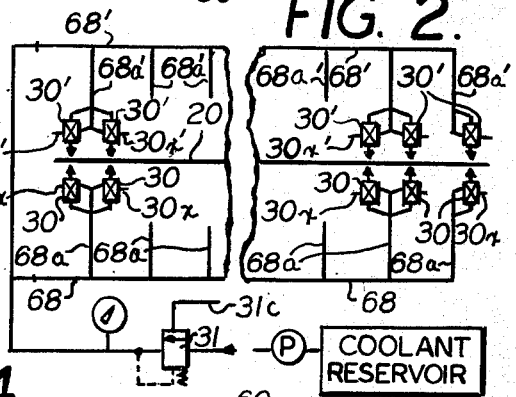
FIG. 2 is a piping diagram showing the way in which coolant is supplied to nozzles and their controls on both sides of the strip at the roll pass in which the gauge of the sheet metal is reduced.

FIG. 2 shows the sheet metal strip 20 and shows nozzles 30 and 30' which are arranged, below and above, respectively, the sheet metal strip 20 across the full width of the sheet. These nozzles are shown diagrammatically in FIG. 2; and they are also shown in FIG. 1 positioned so as to spray coolant against both the top and bottom surfaces of the sheet metal 20 ahead of the roll pass 18–19 and also behind it. Thus the coolant is directed against the surface of the sheet metal 20 as it enters and leaves the bite of the working rolls 18 and 19.

These nozzles 30 and 31', with their built-in adjusting means, are supplied with coolant from manifolds 68 and 68' and branch piping 68*a* and 68*a'*. The built-in adjusting means will be more fully described in connection with FIGS. 5 and 6. When the nozzles adjustment is operated by the coolant, as in the preferred embodiment, the coolant that is used for control purposes bleeds from the nozzles 30 and 30' through discharge passages 30*x* and 30*x'* that lead to manifolds that will be shown and described in connection with FIG. 2*a*.

Coolant is supplied to the manifolds 68 and 68' through a master reducer valve 31 which remains in closed position except when subjected to a master reference signal through a circuit 31*c* connected with the valve 31 as shown in FIG. 2. By supplying master signals to the valve 31, the coolant can be supplied to the manifolds 68 and 68' at selected pressures. Coolant is supplied to the valve 31 from a coolant supply pump 86 as indicated.

FIG. 2*a* shows piping connections by which the nozzles 30 and 30' are divided into different groups transversely of the strip 20. For example, there are five nozzles 30 spaced transversely of the length of the strip 20 and with their discharge passages 30*x* connected to the outlet manifold 32. This center group 32*g* below the strip 20 is located under the similar group 32*g'* of nozzles 30' that have their discharge passages 30*x'* connected with the manifold 32'.

The group 34*g* of nozzles 30, which is shown in FIG. 2*a* includes two nozzles to the right of the center group 32*g* and two nozzles to the left of the center group 32*g* and all nozzles of this other group 34*g* have their discharge passages 30*x* connected with manifold 34. In the embodiment illustrated in FIG. 2*a* the group 40*g* has three nozzles 30 above the strip 20 on both sides of the group 34*g* that are remote from the center group 32*g*. The last group 44*g* of nozzles 30 includes three nozzles nearer to the edges of the strip than the nozzles of group 40*g*.

The discharge passages 30*x* of each nozzle of the four groups 32*g*, 34*g*, 40*g* and 44*g*, are connected with their manifolds 32, 34, 40 and 44, respectively, leading to a different back pressure regulator or loaded valve 52, 54, 55 and 56, respectively. The nozzle groups 32*g'*, 34*g'*, 40*g'* and 44*g'* each have their manifold connected with the same back pressure regulator or loaded valve as the corresponding nozzle groups that are above the strip 20.

The control fluid discharged from the manifolds 32, 34, 40 and 44 flows through the loaded valves 52, 54, 55 and 56, respectively, to a sump or storage reservoir 84. The loading on the valves 52, 54, 55 and 56 imposes back pressure on the nozzles and this back pressure determines the rate of discharge from the nozzles 30 of the different groups as will be explained in connection with FIGS. 5, 6 and 11. Each of the loaded valves is adjustable independently to change the back pressure on the nozzles of its group; and it is possible, therefore, to have a different rate of coolant flow from each of the nozzle groups transversely of the strip 20. These regulators or loaded valves 52, 54, 55 and 56 may be considered broadly as means for supplying signals to the different nozzles and groups of nozzles to change the rate of coolant flow in accordance with the pressure change or signal.

It will be apparent that the amount of cooling of the strip 20 can be regulated by changing the rate at which the coolant is supplied to the different groups of nozzles. Because of the fact that the center portion of the strip is likely to be hotter than the rest of the strip, the regulator 52 may be adjusted to supply more coolant to the nozzles of the center group 34*g* than is supplied to the other nozzles in order to obtain uniform temperature across the strip.

When the mill is used for narrower strips, the nozzles of the group 44*g* may not be necessary because the strip may not be any wider than the group 40.

In the construction of this invention, each of the nozzles 30 and 30' is adjustable; and means for adjusting the nozzles is preferably located at the nozzle. The adjusting means for individual nozzles will be explained in connection with the more detailed views but it should be understood that these adjusting means are at least partially responsive to the back pressure imposed on the control fluid discharged from each group of nozzles through the loaded valves 52–56.

Figure 3:
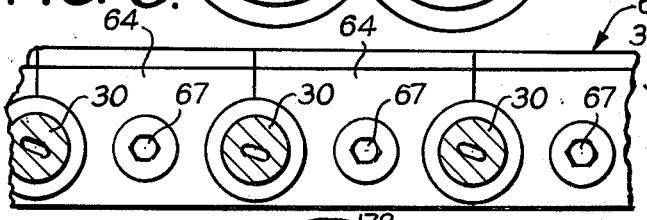
FIG. 3 is a fragmentary front view of one of the spray boards of the cluster mill and showing the locations of the nozzles for cooling fluid opening through the front face of the spray board.
Figure 4:
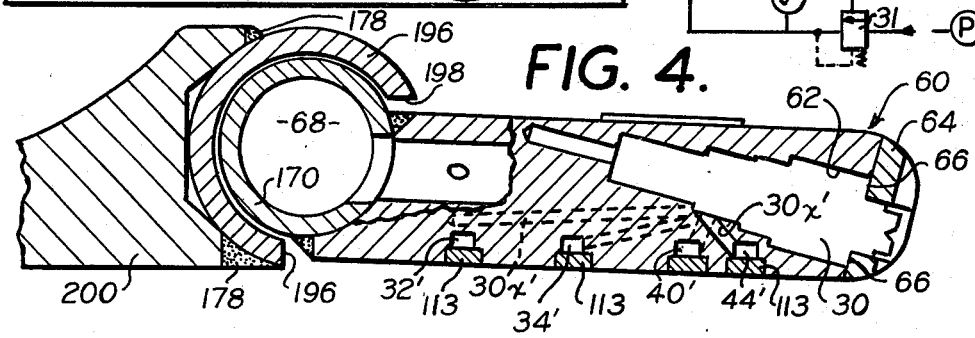
FIG. 4 is a sectional view taken on the line 4—4 of FIG. 7.

FIGS. 3 and 4 show one of the spray boards 60 by which the nozzles 30 are carried. As shown in FIG. 4, there is a recess 62 in the spray board 60 for receiving individual nozzles at the spaced locations across the width of the spray board. These nozzles 30 are individual units which fit into recesses 62. They are held in the recesses by plates 64 which overlap shoulder 66 of the nozzles 30 to hold the nozzles 30 in the recesses 62. The plates 64 are secured to the spray board 60 by detachable fastening means comprising screws 67. The length of each plate 64 is equal to the center distance between nozzles 30 so that individual nozzles can be removed for repair and/or replacement by removing the plates 64 on both sides of the nozzle. The spray board 60 has a manifold 68 for supplying coolant to the different groups of nozzles.

Figure 5:
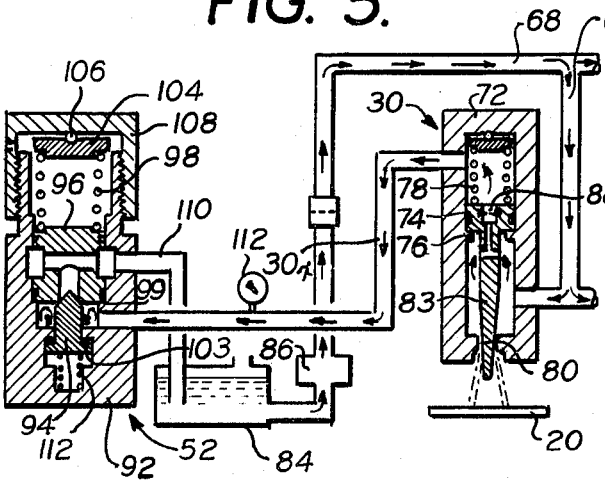
FIG. 5 is a diagrammatic view illustrating a nozzle and means for supplying coolant to the nozzle and for adjusting the rate of discharge from the nozzle in accordance with one embodiment of this invention.

FIG. 5 is a diagrammatic showing of one of the nozzles 30. It does not illustrate the shape of the housing which fits into the recess 62 of the spray board of FIG. 4.

The nozzle 30 includes a housing 72 which encloses a cylindrical chamber in which a piston 74 reciprocates. There is a shoulder 76 in the housing 72 which limits the downward movement of the piston 74. The piston has a sealing ring in accordance with conventional practice and the piston is urged downwardly into contact with the shoulder 76 by a coil spring 78.

The nozzle has an orifice or outlet 80 into which a tongue 83 extends. The tongue 83 is an integral construction with the piston 24 and is shown in FIG. 5 as being of one-piece construction with the piston.

The tongue 83 is tapered and extends through the outlet 80, which may be tapered if desired. When the piston 74 is at the lower end of its stroke, as shown in FIG. 5, the tongue 83 is in its most downwardly extending position in the outlet 80 and the clearance between the tongue 83 and the wall of the outlet 80 is at a minimum. It will be apparent that as the piston 72 moves upwardly in FIG. 5, the rising movement of the tongue 83 will bring a smaller cross section of the tongue into the outlet 80 and the clearance between the tongue and the wall of the outlet will be increased in cross sectional area so that there will be greater flow of coolant from the nozzle.

Coolant is introduced into the housing 72 through passage 68*a* which leads from the manifold 68 that supplies all of the nozzles 30. FIG. 5 shows the coolant flow by arrows and the coolant is shown as being withdrawn from a supply container 84 by a pump 86. The passage 68*a* opens into the housing 72 below the piston 74. There is a bleed orifice 88 opening through the piston 74 so that some of the liquid which flows into the housing 72 from the passage 68*a* bleeds into the housing above the piston 74.

The coolant that flows through the bleed orifice 88, escapes from the housing 72 through the discharge passage 30*x* which leads to a housing 92 of the loaded valve 52. The loaded valve includes a valve element 94 that seats against a movable seat 96. A compression spring 98 holds the seat 96 down against a shoulder 99 in the housing 92. The valve element 94 is pushed up by a spring 102 into contact with the seat 96 until the pressure under the seat 96 is sufficient to cause the valve element 94 to contact a shoulder 103 in the housing 92.

The upper end of the spring 98 seats against an end plate 104 which compresses a ball bearing 106 against a socket at the center of a screw cap 108 that threads over the upper end of the housing 92.

By screwing the cap 108 up or down along its threads, the tension of the spring 98 can be changed so as to change the loading on the seat 96 and the valve 94. The less the tension on the spring 98, the easier the seat 96 can move upwardly and the lower the pressure can be in the discharge passage 30*x* for lifting the seat 96.

When the seat 96 rises, coolant flows through a passage 110 and back to the coolant container 84 or to waste if the system is not a recycling system. In FIG. 5 the spring 98 is under substantial compression and a high pressure in the discharge passage 30*x* is necessary to lift the seat 96. The pressure in the discharge passage 30*x* is high, as indicated by a gauge 112. The pressure of coolant in the housing 72 above the piston 74 is as high as it is in the discharge passage 30*x* and this pressure together with the force of the spring 78 holds the piston 74 at the lower end of its stroke and pushes the tongue 83 into the orifice 80 far enough to cut the flow of liquid to its minimum value.

Figure 6:
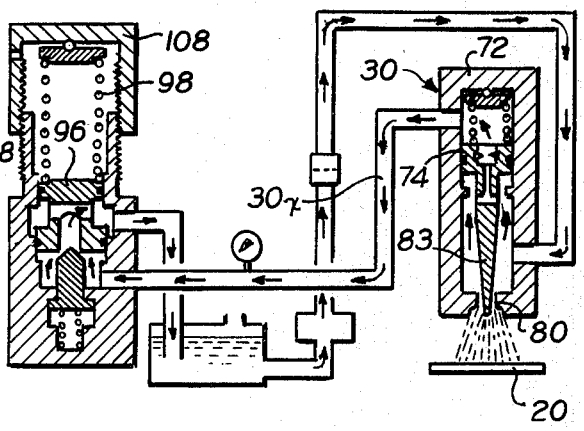
FIG. 6 is a view similar to FIG. 5 but showing a different adjustment of the back pressure control means of FIG. 5.

FIG. 6 shows the screw cap 109 screwed up on the threads of the housing 92 far enough to greatly reduce the pressure of the spring 98. This permits the seat 96 to rise with substantially lower pressure in the discharge passage 30*x* and the flow of coolant from the housing 72 above the piston 74 reduces the pressure against the top of the piston 74 so that the pressure of coolant under the piston lifts the piston 74 against the pressure of the spring 78. This moves the tongue 83 upwardly and results in the open cross section between the tongue and the wall of the orifice 80 being greatly increased with resulting increase in flow of coolant to the metal strip 20.

From a comparison of FIGS. 5 and 6, it will be apparent that the loaded valve 52 at the downstream end of the discharge passage 30*x* provides an adjustable regulator for changing the amount of flow from the nozzles 30. It will be apparent, however, that the regulators or loaded valves 52, 54, 55 and 56 (FIG. 2*a*) can be used in series with the manifolds 32, 34, 40 and 44, respectively, of each group of nozzles to change the back pressure in the discharge passages 30*x* and the resulting rate of flow of coolant to the nozzles 30 of the respective groups.

Referring again to FIG. 4, the manifold 68 supplies coolant at the same pressure to all of the nozzles of all of the groups 32*g*, 34*g*, 40*g* and 44*g*; and the rate of discharge of the nozzles of each individual group is determined by the back pressure in the manifolds 32, 34, 40 and 44, which are channels in the bottom side of the spray board 60 covered by closure strips 113 permanently secured to the spray board.

Figure 11:
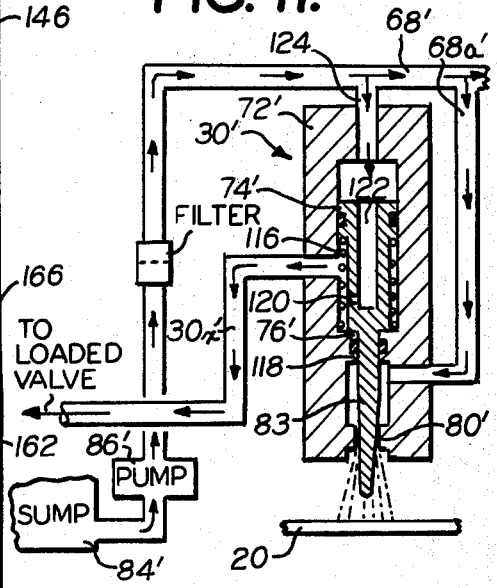
FIG. 11 is a diagrammatic view showing a modified form of the structure shown in FIGS. 5 and 6.

The operation of the nozzle 30, shown in FIGS. 5 and 6, can be modified so that in a sense it is just the reverse of that illustrated in FIGS. 5 and 6. Such a modification is shown in FIG. 11. Parts in FIG. 11 which correspond with those in FIG. 5 are indicated by the same reference character with a prime appended. A nozzle 30' includes a housing 72' in which a piston 74' moves up and down in the cylindrical interior of the housing 72'. A shoulder 76' is located lower in the housing 30' than the shoulder shown in FIG. 5 and there is a spring 116 compressed between the underside of the piston 74' and the shoulder 76'. A seal 118 in the shoulder 76' seals the cylinder above the shoulder from the space in the housing 72' below the shoulder. Coolant flows from the manifold 68' through passage 68*a'* to the space in the housing 72' below the shoulder 76' and all of the coolant that enters the space can escape only through the orifice 80' of the nozzle.

In FIG. 11 the bleed passage consists of an orifice 120 which leads from a center bore 122 through the outside surface of the piston 74' where the diameter of the piston is reduced and surrounded by the spring 116. There is an extra passage 124 leading from the manifold 68' into the top of the housing 72' and communicating with the cylinder in which the piston 74' slides and at a location above the piston. Instead of coolant passing upward through the piston and escaping through a discharge passage as in FIGS. 5 and 6, the coolant in FIG. 11 passes from above the piston 74' through a bleed passage 120 in the piston and past the convolutions of the spring 116 to a discharge passage 30*x'*. This bypass 30*x'* leads to a loaded valve, as in FIGS 5 and 6, and discharges into a container or sump 84' or to waste if the system does not recycle.

The principal difference in the operation of the construction shown in FIG. 11, as compared with that shown in FIGS. 5 and 6, is that increase in back pressure in the discharge passage 30*x'* in FIG. 11 causes the piston 74' to rise with the aid of the spring 116, whereas increase in back pressure in the discharge passage 30*x* in FIGS. 5 and 6 cause the piston 74 to move downwardly. Since the taper on the tongue 82' of FIG. 11 and 82 in FIGS. 5 and 6 is in the same direction, an increase in back pressure in the discharge passage 30x' of FIG. 11 causes the flow from the nozzle 30' to increase whereas an increase in the back pressure in the discharge passage 30x in FIGS. 5 and 6 caused the piston 74 to move down and reduce the flow of coolant from the nozzle. In both cases, however, the rate of flow of coolant from the nozzle can be adjusted by changing the loading on the valve at the end of the discharge passage 30x or 30x'. The only difference is that the adjustment must be toward high pressure in one case and lower back pressure in the other case.

Figure 7:
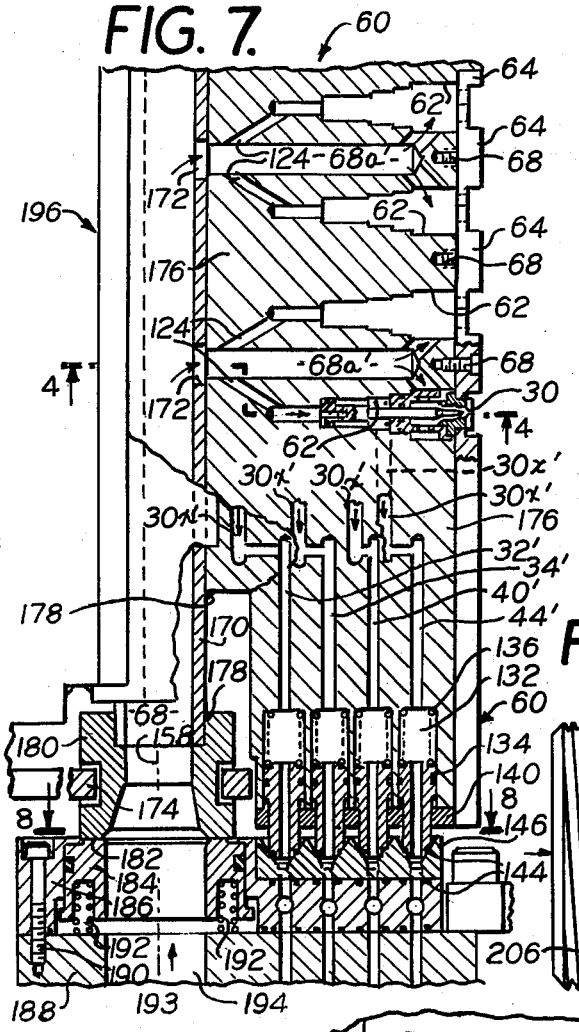
FIG. 7 is a sectional view, on a reduced scale, through the spray board shown in FIG. 4, but also showing the construction of the apparatus at and beyond one end of the spray board.
Figure 9:
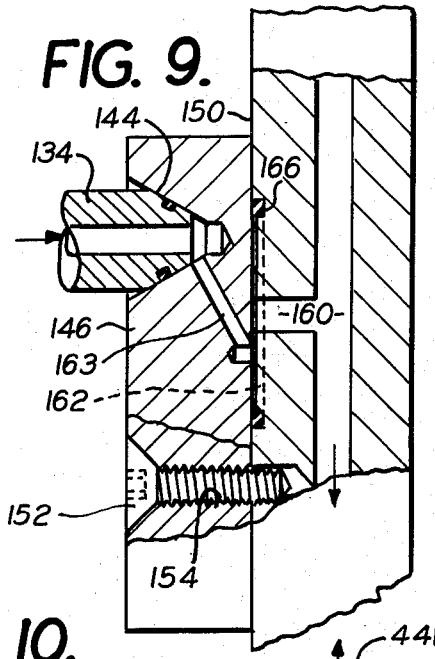
FIG. 9 is an enlarged sectional view taken on the section line 9—9 of FIG. 8.

FIG. 7 is a sectional view through a part of the spray board 60 and showing the recesses 62, for the nozzles, equipped with coolant supply passages for a nozzle such as shown in FIG. 11. For example, there are passages 124 leading from the supply manifold 68 into the upper ends of the nozzle recesses 62, and FIG. 7 also shows passages 68a' leading into the nozzle recesses 62 at a location near the orifice 80 (FIG. 11) of the nozzle. The only nozzle 30 which is shown in a recess in FIG. 7 has a discharge passage 30x' communicating with the channel 44'. Other nozzles of other groups have corresponding passages 30x' communicating with the channels 32', 34' and 40' so that the control of flow from different groups of nozzles can be regulated by controlling the back pressure on the channels.

In actual practice, the loaded valves shown in FIGS. 5 and 6 are not located on the spray boards and they are preferably at locations on portions of the apparatus which does not adjust to change the angle of impingement of the cooling jets on the workpiece or sheet metal strip.

FIG. 7 shows equally spaced channels 32', 34', 40' and 44'. These channel passages lead to counterbores 132 in the end of the spray board 60. There is a fitting 134 located in each of the counterbores 132 and slidable in these counterbores like pistons in a cylinder. Coil springs 136 urge the fittings 134 toward the end of the spray board 60. There is a plate 140 across the ends of the counterbores 32; and the portions of the fittings 134 that extend through openings in this plate 140 are somewhat smaller in diameter than the counterbores 132 so that the fittings 134 have shoulders on them which limit the extent to which the fittings can be pushed out of the counterbores 132.

Each of the fittings 134 has a tapered end face 144 which fits into a complementary tapered seat in a plate 146 which moves as a unit with the spray board 60 from which the fittings 134 extend. This plate 146 moves over the face of a fixed surface 150 to which the plate 146 is attached by screws 152 extending through slots 154 in the plate 146. These screws are released to permit movement of the spray board 60 about its axis of rotation 158. The slots 154 are long enough to accommodate the necessary adjustment of the spray board 60 to obtain the full range of impingement angles of the nozzle sprays against the sheet metal.

Openings 160 through the fixed surfaces 150 communicate with arcuate depressions 162 in the surface 150. These arcuate depressions 162 are long enough, and curved about the axis of rotation of the plate 146 so that a passage 163 from the end of the socket into which the tapered end faces 144 engage is always in communication with the depression 162, and therefore in communication with the opening 160 regardless of the adjustment of the plate 146 along the slots 154. There is a sealing ring 166 between the outside edges of the depression 162 and the back face of the plate 146 to prevent leakage of coolant as it flows through the fitting 134 and into the depression 162.

Figure 8:
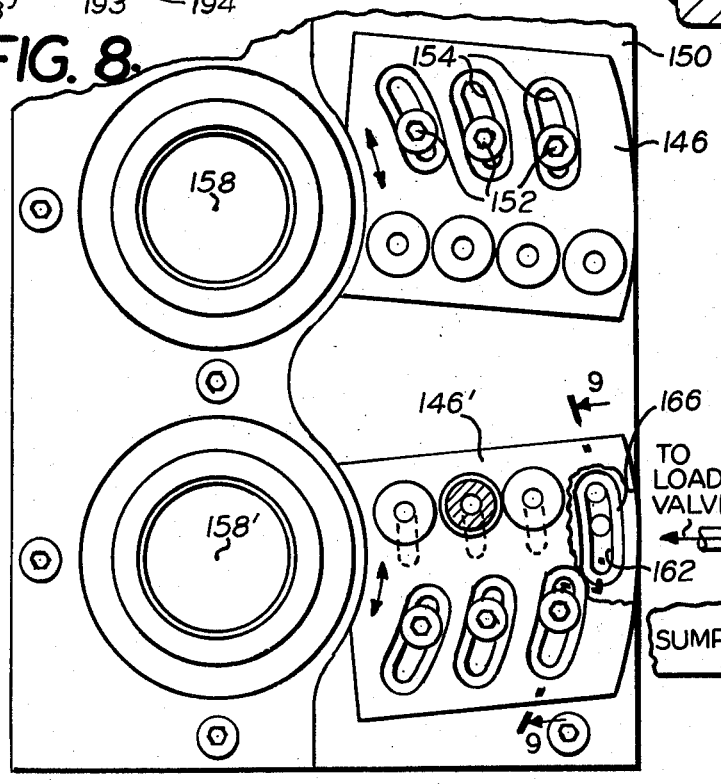
FIG. 8 is an enlarged view taken on the line 8—8 of FIG. 7.

FIG. 8 shows a similar plate 146' for the lower spray board which is under the sheet metal.

Referring again to FIG. 7, the spray boards 60 each consist of a pipe element 170 with spaced openings 172 through which coolant is supplied to the passages leading to the recesses 62 in which the nozzles are located. The pipe element 170 has a support 174. It will be understood that there are supports 174 at opposite ends of the pipe element 170 and that the end of the pipe element 170 is closed at the end remote from that shown in FIG. 7.

The passages and recesses for the nozzles are in a plate element 176 which is secured to the pipe element by welding 178, or in any other manner that makes the spray board an integral unit.

The portions of the pipe element 170, which move with the spray board, are preferably secured to fittings 180 by welding 178 which makes each fitting 180 of integral construction with the rest of the pipe element 170.

The fitting 180, shown in FIG. 7, has an end face 182 which abuts against a sealing fitting 184 that rotates in a fixed bearing 186 secured to a main frame 188 by detachable fastening means 190. Compression springs 192 press the fitting 184 against the sealing face 183 to provide a movable seal passage for coolant flowing to the spray board through a passage 193 and in the direction indicated by the arrow 194, in FIG. 7.

In addition to the supports 174, the spray board 60 is supported by another bearing element 196 which extends for most of the length of the pipe element 170 and which encloses most of the circumference of the pipe element 170, as shown in FIG. 4. There is enough open space between the angular end faces 198 of the bearing 196 to permit the desired angular movement of the spray board 60. This bearing 196 is attached to a fixed part of the frame of the cluster mill which supports the spray boards 60 and there is such a fixed frame section for each of the spray boards.

Figure 10:
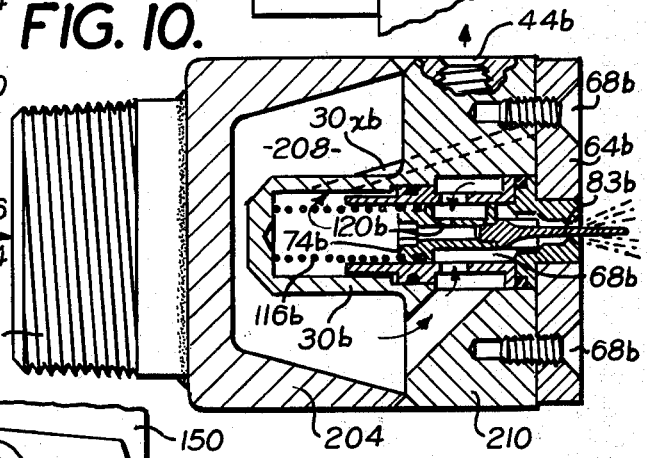
FIG. 10 is a sectional view showing a modified form of the invention.

FIG. 10 shows a modified construction in which a housing 204 is supplied with coolant through a threaded fitting 206. The housing 204 contains a chamber 208 which is closed at its forward end by a block 210 into which a nozzle fitting is placed. The socket in the block 210 that houses the nozzle structure has a plate 64b secured to it by detachable fastening means, comprising screws 68b. Parts of the structure shown in FIG. 10 that correspond with similar parts in other views are indicated by the same reference character with a letter b appended.

The construction of the nozzle in FIG. 10 is similar to that shown diagrammatically in FIG. 11 and the passage 68b of FIG. 11 is partly in the block 210 in FIG. 10 and partly within the space around the piston 74b. Coolant entering the housing 30b on the side of the piston 74b to which the tongue 83b is connected, flows through a bleed orifice 120b into the space on the side of the piston remote from the tongue 73b. This portion of the housing has a discharge passage 30xb which opens through the wall of the housing 20b and through the block 210 to an outlet 44b which corresponds to the manifold 44 of FIGS. 4 and 7.

The preferred embodiments of this invention have been illustrated and described, but changes and modifications can be made, and some features can be used in different combinations without departing from the invention as defined in the claims.

What is claimed is:

1. Apparatus for rolling sheet metal including in combination rolls comprising a roll pass for passage of sheet metal through a bite of the rolls as the sheet metal travels therethrough to reduce the thickness of the sheet, and means for cooling the sheet metal comprising a plurality of groups of spray nozzles having discharge outlets, the nozzles being at spaced locations in directions parallel to the axes of the rolls and across the width of the sheet, a supply passage that communicates with said nozzles at different locations widthwise of the sheet, adjustment means at each nozzle for controlling the rate of coolant flow, and different control apparatus connected with said adjustment means of the different nozzles for regulating the flow of coolant selectively to the different nozzles, characterized by each of the nozzles having a movable element extending into the discharge outlet and movable with respect to the outlet to change the cross-section of the coolant discharge outlet area of the nozzle to prevent a reduction in the rate of coolant flow from causing a corresponding reduction in the velocity of the discharge of the coolant spray from the nozzle, the adjustment means comprising a chamber upstream from the discharge outlet, a movable wall with one side facing said chamber and responsive to changes in the rate of flow of coolant to the nozzle and operatively connected with said movable element, so that said element moves in response to movement of said wall, and means for exerting a counter pressure against the other side of the wall.

2. The apparatus described in claim 1 characterized by one group of nozzles being in position to cool a central longitudinal zone of the sheet, another group of nozzles being in position to cool two longitudinal zones of the sheet, each of said two longitudinal zones being adjacent to a different side of the central zone, and a third group of nozzles in position to cool two additional longitudinal zones of the sheet metal adjacent to the first two longitudinal zones on the sides of the first longitudinal zones that are remote from the central zone, each of the groups having its own adjustable means remote from the rolls and nozzles for controlling said adjustable means at the individual nozzles.

3. The apparatus described in claim 1 charcterized by the means for adjusting each of the nozzles including a tongue that extends into a coolant discharge outlet of the nozzle, a movable wall connected with the tongue for transmitting motion to the tongue, a chamber of which the movable wall forms one side, means for supplying a unidirectional flow of coolant to the chamber to exert a continuous pressure on the wall in one direction, a spring that exerts pressure on the wall in the opposite direction, a bleed conduit through which coolant escapes from the chamber, a loaded relief valve in the bleed conduit, and means for changing the loading on the relief valve to adjust a back pressure in the chamber and to control the position of the movable wall and the resulting area of opening of a nozzle discharge outlet and automatic control means for adjusting the nozzles, the automatic control means having an element that moves in response to variations in back pressure signals applied to the nozzle adjustment means.

4. The apparatus described in claim 3 characterized by the coolant discharge outlet of each nozzle having a surface that confronts a surface of the tongue, one of the surfaces being tapered so that relative movement of the tongue along the axis of the outlet changes the open cross section of the nozzle coolant discharge outlet through which coolant flows from the nozzle, and the elements of the automatic control means that move in response to variations in a back pressure signal of the bleed orifice being a piston upstream of the discharge orifice and exposed to pressure of the coolant in the nozzle.

5. The apparatus described in claim 1 characterized by the adjustment means including a movable wall enclosing a chamber, means that apply a unidirectional flow of coolant to the chamber, and means exposed to back pressure of the coolant that flows through the discharge orifice for changing the open area of the discharge orifice of the nozzle.

6. The apparatus described in claim 5 characterized by each nozzle having movable elements that move with respect to one another to change the discharge of coolant from the nozzle, the movement being in a direction to increase the discharge of coolant in response to increase in the back pressure of the coolant that flows through the discharge orifice.

7. The apparatus described in claim 5 characterized by a bleed orifice through which coolant flows from one side of the movable wall to the other to reduce the pressure on one side of the wall.

8. The apparatus described in claim 7 characterized by a bypass passage for coolant that passes through the bleed orifice, and through which the coolant escapes without passing through the nozzle.

9. The apparatus described in claim 5 characterized by the adjustment means including a loaded valve commanding the flow of fluid through a bypass, and means for adjusting the loading of the valve to change the back pressure, of the coolant that flows through the discharge orifices, that the loaded valve imposes on the coolant in the bypass and in the chamber behind the movable wall.

10. The apparatus described in claim 9 characterized by the bypass communicating with the chamber on a side of the movable wall on which increased pressure adjusts the nozzle to obtain a greater rate of flow.

11. The apparatus described in claim 9 characterized by the bypass passage communicating with the chamber on a side of the movable wall on which increased pressure adjusts the nozzle to obtain a reduced rate of flow.

12. The apparatus described in claim 1 characterized by the control apparatus for the different groups including an adjustable mater regulator that determines a back pressure of control coolant that flows back through a bleed orifice associated with each nozzle, and the nozzles of said different groups of nozzles having the means for adjusting the areas of the discharge outlets of the nozzles to change the rate of discharge of the coolant from the nozzles against the sheet metal, said means for adjusting the nozzles including movable walls that are displaced in response to the back pressure of the coolant that flows through the bleed orifice and then through regulators, and another adjustable pressure regulator that controls the pressure of the supply of coolant to the nozzles.

13. The apparatus described in claim 1 characterized by spray boards extending across the width of the roll pass, there being spray boards both above and below the sheet metal and both ahead of and behind the roll pass, some of the nozzles being carried by each of the spray boards and being movable as units with the respective spray boards, supports for each of the spray boards and on which the spray board is adjustable angularly about a pivotal axis of movement to change the angle of impingement, against the sheet metal, of coolant sprays from the nozzles, a supply passage for the different groups of nozzles of each spray board extending along the width of the spray boards and terminating at one end of the spray board at a location near said axis of angular movement of the spray board and the coolant passages of each spray board including return passages for a portion of the coolant that flows back from each nozzle, said return coolant passages terminating in outlet ports that open through an end face of the spray board, said end face being movable as a unit with the spray board, other faces in fixed position and confronting the respective end faces of the spray boards, ports in said other faces through which coolant flows from the outlet ports of the end faces of the spray boards, said other faces being relatively fixed with respect to said end faces so that the end faces of the spray boards move parallel to and over said other relatively fixed faces when the spray boards are moved angularly on their supports, the ports in one of the confronting faces at each of the spray boards being an arcuate port so that it communicates with the port of the face that it confronts regardless of the adjustment of the spray board angularly on its supports, and sealing means between the confronting faces around each of the arcuate ports for sealing the region at which the inlet and discharge ports communicate with one another.

* * * * *